US007225774B2

(12) United States Patent
Watanabe et al.

(10) Patent No.: US 7,225,774 B2
(45) Date of Patent: Jun. 5, 2007

(54) VALVE TIMING CONTROL APPARATUS FOR INTERNAL COMBUSTION ENGINE

(75) Inventors: Kotaro Watanabe, Kanagawa (JP); Hidekazu Yoshida, Kanagawa (JP); Tomoya Tsukada, Kanagawa (JP); Hideyuki Miyasaka, deceased, late of Kanagawa (JP); by Jiro Miyasaka, legal representative, Chiba (JP); by Ayako Miyasaka, legal representative, Chiba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/227,125

(22) Filed: Sep. 16, 2005

(65) Prior Publication Data

US 2006/0060161 A1 Mar. 23, 2006

(30) Foreign Application Priority Data

Sep. 17, 2004 (JP) ..... 2004-270717

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31, 90.65, 90.67
See application file for complete search history.

(56) References Cited

U.S. PATENT DOCUMENTS 6,336,433 B1 * 1/2002 Anton et al. ..... 123/90.17
6,450,138 B1 9/2002 Kinugawa et al.

FOREIGN PATENT DOCUMENTS

WO WO 01/55562 A1 8/2001

* cited by examiner

*Primary Examiner*—Thomas Denion
*Assistant Examiner*—Zelalem Eshete
(74) *Attorney, Agent, or Firm*—Foley & Lardner LLP

(57) ABSTRACT

A valve timing control apparatus for an internal combustion engine includes a housing having a housing body and shoes protruding from an inner circumferential surface of the housing body to define actuation spaces therebetween, a vane rotor disposed in the housing and having a rotor body and vanes protruding from an outer circumferential surface of the rotor body to divide the actuation spaces into circumferentially alternating first and second hydraulic chambers, a plurality of spring units arranged in at least either the first hydraulic chambers or the second hydraulic chambers to bias the vane rotor in a rotational direction with respect to the housing, and a rotation restriction mechanism capable of restricting a relative rotation of the housing and the vane rotor to prevent the shoes and the vanes from contact with each other within the hydraulic chambers in which the spring units are arranged.

20 Claims, 7 Drawing Sheets

VALVE TIMING CONTROL APPARATUS FOR INTERNAL COMBUSTION ENGINE

BACKGROUND OF THE INVENTION

The present invention relates to a valve timing control apparatus for an internal combustion engine.

WO 01/055562 proposes a vane-type valve timing control apparatus for an internal combustion engine, which includes a housing, a vane rotor disposed in the housing with hydraulic chambers defined between the housing and the vane rotor and a plurality of springs retained in the hydraulic chambers by holders to urge the vane rotor to a given rotational position with respect to the housing and, when the engine is in a stop state, adjust a valve lift phase in such a manner as to attain appropriate engine starting performance.

SUMMARY OF THE INVENTION

The above-proposed valve timing control apparatus is configured to allow direct contact between shoes of the housing and vanes of the rotor upon rotation of the rotor against the tensions of the springs. In this configuration, however, wear dust is likely to occur due to contact between the springs and the shoes/vanes or sliding friction between the spring holders and the shoes/vanes during compression of the springs. There arises a problem that the rotor deteriorates in operation response when such wear dust gets caught in sliding gaps upon contact between the shoes and the vanes. When the wear dust is too large in size to pass through a hydraulic passage of the apparatus, the internal volumes of the hydraulic chambers decrease to bring the vanes into contact with the housing and thereby initiate a pulverization of the dust. The pulverized dust flows into a hydraulic actuator through the hydraulic passage and becomes a cause of a defect or malfunction in the actuator.

It is therefore an object of the present invention to provide a vane-type valve timing control apparatus for an internal combustion engine, capable of preventing a deterioration in operation performance due to wear dust (pieces).

According to a first aspect of the invention, there is provided a valve timing control apparatus for an internal combustion engine, comprising: a rotary member rotated by a crankshaft of the engine; a housing fixed to one of the rotary member and a camshaft of the engine, the housing having a housing body and shoes protruding from an inner circumferential surface of the housing body to define actuation spaces therebetween; a vane rotor disposed in the housing and fixed to the other of the rotary member and the engine camshaft, the vane rotor having a rotor body and vanes protruding from an outer circumferential surface of the rotor body into the respective actuation spaces to divide the actuation spaces into circumferentially alternating first and second hydraulic chambers; a fluid supply/drain block through which hydraulic fluid is supplied to and drained out of the first and second hydraulic chambers; a plurality of spring units arranged in at least either the first hydraulic chambers or the second hydraulic chambers to bias the vane rotor in a rotational direction with respect to the housing; and a rotation restriction mechanism capable of restricting a relative rotation of the housing and the vane rotor to prevent the shoes and the vanes from coming into contact with each other within the at least either the first hydraulic chambers or the second hydraulic chambers in which the spring units are arranged.

According to a second aspect of the invention, there is provided a valve timing control apparatus for an internal combustion engine, comprising: a rotary member rotated by a crankshaft of the engine; a housing fixed to one of the rotary member and a camshaft of the engine, the housing having a housing body and shoes protruding from an inner circumferential surface of the housing body to define actuation spaces therebetween; a vane rotor disposed in the housing and fixed to the other of the rotary member and the engine camshaft, the vane rotor having a rotor body and vanes protruding from an outer circumferential surface of the rotor body into the respective actuation spaces to divide the actuation spaces into circumferentially alternating first and second hydraulic chambers; a fluid supply/drain block through which hydraulic fluid is supplied to and drained out of the first and second hydraulic chambers; and a plurality of springs arranged in at least either the first hydraulic chambers or the second hydraulic chambers to bias the vane rotor in a rotational direction with respect to the housing, wherein, in case of breakage of the springs, the at least either the first hydraulic chambers or the second hydraulic chambers in which the springs are arranged allow space to accommodate therein broken pieces of the springs during maximum compression of the springs.

According to a third aspect of the invention, there is provided a valve timing control apparatus for an internal combustion engine, comprising: a rotary member rotated by a crankshaft of the engine; a housing fixed to one of the rotary member and a camshaft of the engine, the housing having a housing body and shoes protruding from an inner circumferential surface of the housing body to define actuation spaces therebetween; a vane rotor disposed in the housing and fixed to the other of the rotary member and the engine camshaft, the vane rotor having a rotor body and vanes protruding from an outer circumferential surface of the rotor body into the respective actuation spaces to divide the actuation spaces into circumferentially alternating first and second hydraulic chambers; a fluid supply/drain block through which hydraulic fluid is supplied to and drained out of the first and second hydraulic chambers; a plurality of springs arranged in at least either the first hydraulic chambers or the second hydraulic chambers to bias the vane rotor in a rotational direction with respect to the housing; and a protrusion extending radially from the outer circumferential surface of the rotor body toward one of the springs within any of the hydraulic chambers in which the one of springs is arranged.

The other objects and features of the invention will also become understood from the following description.

DESCRIPTION OF THE EMBODIMENTS

Figure 1:
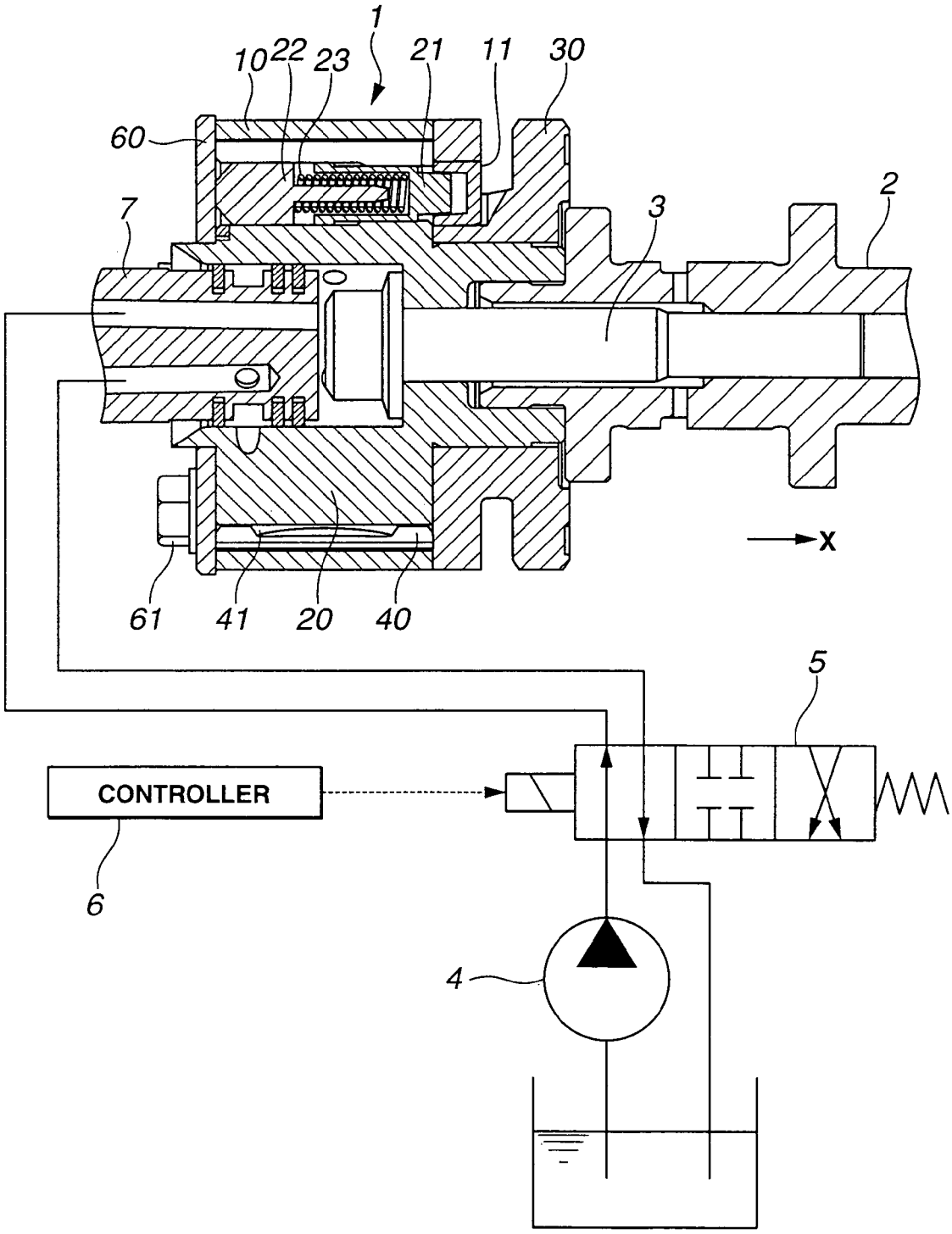
FIG. 1 is a schematic view of a valve control system for an internal combustion engine according to a first embodiment of the invention.

The present invention will be described in detail by way of the following first to fourth embodiments in which like parts and portions are designated by like reference numerals to omit repeated explanations thereof.

The first embodiment of the present invention will be now explained below with reference to FIGS. 1 to 6.

As shown in FIG. 1, there is provided according to the first embodiment a valve control system for an internal combustion engine, including a valve timing control (VTC) apparatus 1, an oil pump 4, a hydraulic actuator 5 and a controller 6. The VTC apparatus 1 is mounted on an intake or exhaust camshaft 2 of the engine to change the rotational phase of a crankshaft of the engine relative to the camshaft 2 and thereby control the valve open/close timing of an intake or exhaust valve of the engine in response to the supply of hydraulic oil from the oil pump 4. The hydraulic actuator 5 is disposed between the VTC apparatus 1 and the oil pump 4 and driven under a control signal from the controller 6 to regulate the hydraulic oil supply from the oil pump 4 to the VTC apparatus 1. The controller 6 receives input about engine operating conditions, such as engine temperature, speed and load, via a coolant temperature sensor, a crank angle sensor and a throttle opening sensor and drives the actuator 5 according to operating conditions of the engine. Hereinafter, the term "x axis" is defined as an axis extending in parallel to the camshaft 2 in the direction of an arrow X indicated in FIGS. 1 and 2, and the terms "front" and "rear" are defined with respect to the x-axis direction in the following description. It should be noted that these terms are used for descriptive purposes to recite relative positions of various parts without limiting the locations of the parts to such positions.

Figure 2:
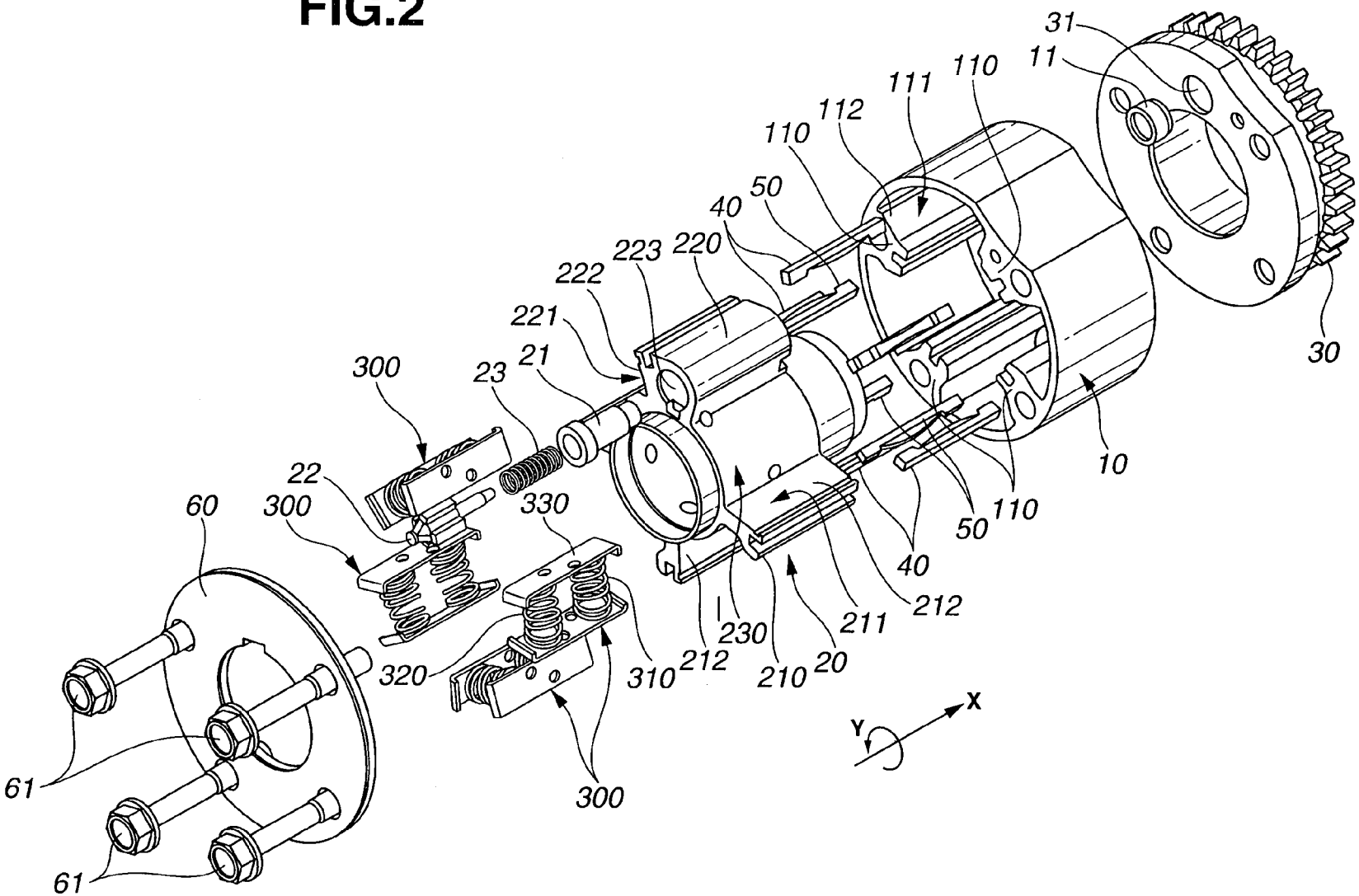
FIG. 2 is an exploded perspective view of a valve timing control apparatus of the valve control system according to the first embodiment of the invention.

The VTC apparatus 1 has a cylindrical housing (body) 10, a vane rotor 20 disposed in the housing 10 and fixed to a rear end of the camshaft 2 by a cam bolt 3 in such a manner that the vane rotor 20 rotates together with the camshaft 2 relative to the housing 10, a sprocket 30 (as a rotary member) fixed to a front end of the housing 10 and rotated by the engine crankshaft via a chain and an oil supply/drain block 7 arranged in the vane rotor 20 as shown in FIGS. 1 and 2. The terms "normal rotation" and "reverse rotation" are herein used with respect to the rotation of the vane rotor 20 relative to the housing 10 in the counterclockwise direction as indicated by an arrow Y in FIGS. 2, 4 and 5 and in the clockwise direction when viewed in the x-axis direction, respectively, for descriptive purposes. It should be also noted that the axis of relative rotation between the housing 10 and the vane rotor 20 is in parallel to the x axis.

The housing 10 has a plurality of shoes 110 protruding radially inwardly from an inner circumferential surface thereof and thereby dividing a gap between the housing 10 and the vane rotor 20 into actuation spaces. In the first embodiment, four shoes 110 are circumferentially evenly spaced around the housing 10 so as to define four actuation spaces. A plate member 60 is fixed to the housing 10 by bolts 61 to seal a rear open end of the housing 10 with the plate member 60.

The vane rotor 20 has a rotor body 230 and a plurality of vanes: three first vanes 210 and a single second vane 220 protruding radially outwardly from an outer circumferential surface of the rotor body 230 into the respective actuation spaces and thereby dividing the actuation spaces into first hydraulic chambers 500 and second hydraulic chambers 600 such that the first hydraulic chambers 500 circumferentially alternate with the second hydraulic chambers 600. The first hydraulic chambers 500 are located on the normal rotation sides of the vanes 210 and 220, whereas the second hydraulic chambers 600 are located on the reverse rotation sides of the vanes 210 and 220. The vanes 210 and 220 are circumferentially evenly spaced around the rotor body 230 so as to improve the weight balance of the vane rotor 20 and minimize the shaking of the vane rotor 20 upon actuation of the VTC apparatus 1. Further, the second vane 220 is made greater in circumferential width than the first vanes 210 and formed with a through hole 223 along the x-axis direction.

The hydraulic oil from the oil pump 4 is supplied to and drained out of the hydraulic chambers 500 and 600 selectively via the oil supply/drain block 7 so as to transmit rotation between the housing 10 and the vane rotor 20 via the hydraulic oil. Seals 40 and 50 are provided in outer circumferential faces of the vanes 210 and 220 and inner circumferential faces of the shoes 110 and pushed by seal springs 41 and 51 to the inner circumferential surface of the housing 10 and the outer circumferential surface of the rotor body 230, respectively. The hydraulic chambers 500 and 600 are thus sealed by the seals 40 and 50 against leakage of the hydraulic oil from the hydraulic chambers 500 and 600. Through the regulation of the hydraulic oil supply to the hydraulic chambers 500 and 600, the internal volumes of the hydraulic chambers 500 and 600 are adjusted to cause a relative rotation between the housing 10 and the rotor 20 and then change the rotational phase of the engine crankshaft relative to the camshaft 2.

The VTC apparatus 1 also has a lock mechanism capable of locking the vane rotor 20 in a given rotational position with respect to the housing 10, a spring mechanism capable of biasing the vane rotor 20 in a reverse rotation direction with respect to the housing 10 and a rotation restriction mechanism capable of restricting the relative rotation between the housing 10 and the vane rotor 20 in such a manner as to prevent the shoes 110 and the vane 210 and 220 from each other when the spring mechanism is in a compression state.

As shown in FIGS. 1 and 2, the lock mechanism includes a lock pin 21, a spring holder 22, a spring 23 and a sleeve 11. The lock pin 21 is slidably inserted in the through hole 223 of the second vane 220. The spring 23 is fitted around the lock pin 21 and retained by the spring holder 22 to urge the lock pin 21 in the x-axis direction and cause the lock pin 21 to project from the hole 223 of the second vane 220. The sleeve 11 is attached to the housing 10 in contact with a sleeve holder 31 of the sprocket 30 to receive an end portion of the lock pin 21 and prevent an axial displacement of the lock pin 21. When the engine stops, the hydraulic pressures in the hydraulic chambers 500 and 600 become released. The lock pin 21 is then engaged in the sleeve 11 under the tension of the spring 23 so as to restrict the relative rotation of the housing 10 and the vane rotor 20 and secure the rotational phase of the engine crankshaft relative to the camshaft 2 appropriately for the restart of the engine. In such a locked state, the vane rotor 20 can be prevented from being flapped due to an alternate torque caused by the interaction between a drive cam and a valve spring of the valve. When the hydraulic chambers 500 and 600 are supplied with hydraulic oil after the engine start, the lock pin 21 is moved against the tension of the spring 23 and disengaged from the sleeve 11 to allow the relative rotation of the housing 10 and the vane rotor 20. (Namely, the hydraulic oil serves as means for disengaging the lock pin 21 from the sleeve 11 according to a starting condition of the engine in the first embodiment.)

Figure 4:
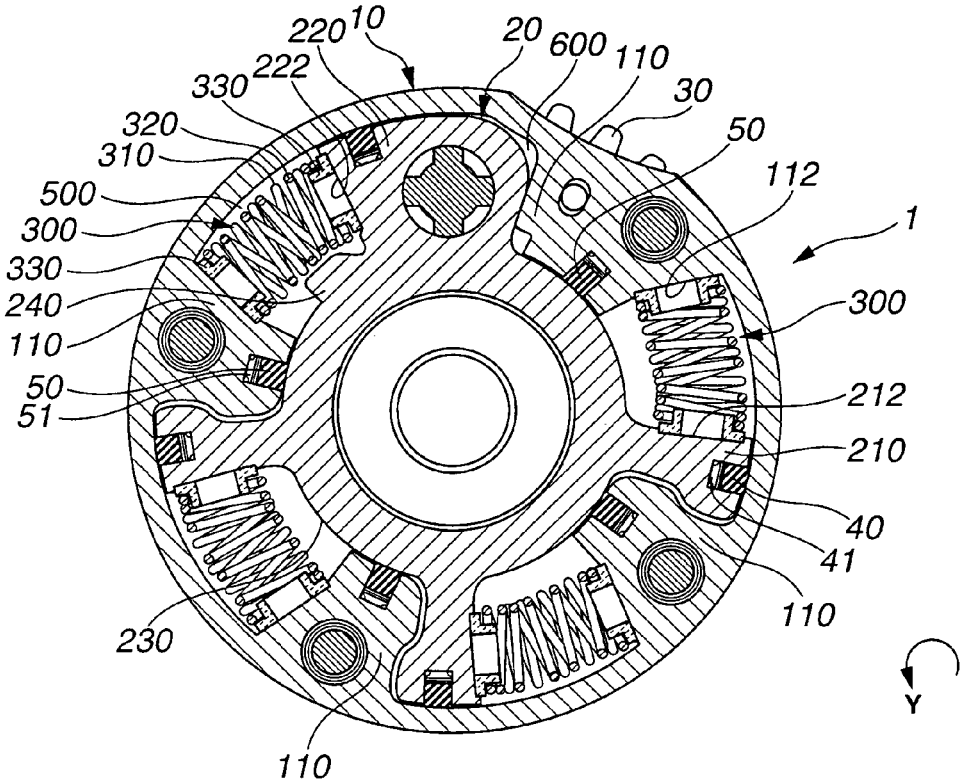
FIG. 4 is a sectional view of the valve timing control apparatus, when brought to an angular position at which the valve timing is most advanced, according to the first embodiment of the invention.
Figure 5:
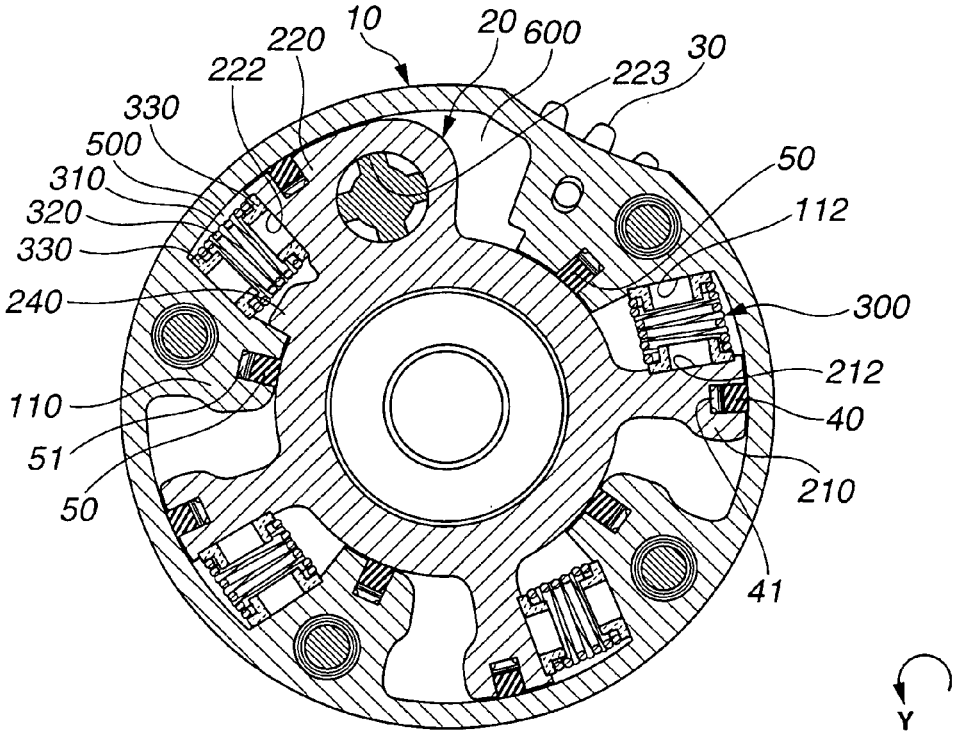
FIG. 5 is a sectional view of the valve timing control apparatus, when brought to an angular position at which the valve timing is most retarded, according to the first embodiment of the invention.

The spring mechanism includes spring units 300 arranged in at least either the hydraulic chambers 500 or the hydraulic chambers 600. In the first embodiment, the spring units 300 are arranged in respective ones of the first hydraulic chambers 500 as shown in FIGS. 4 and 5.

Figure 3:
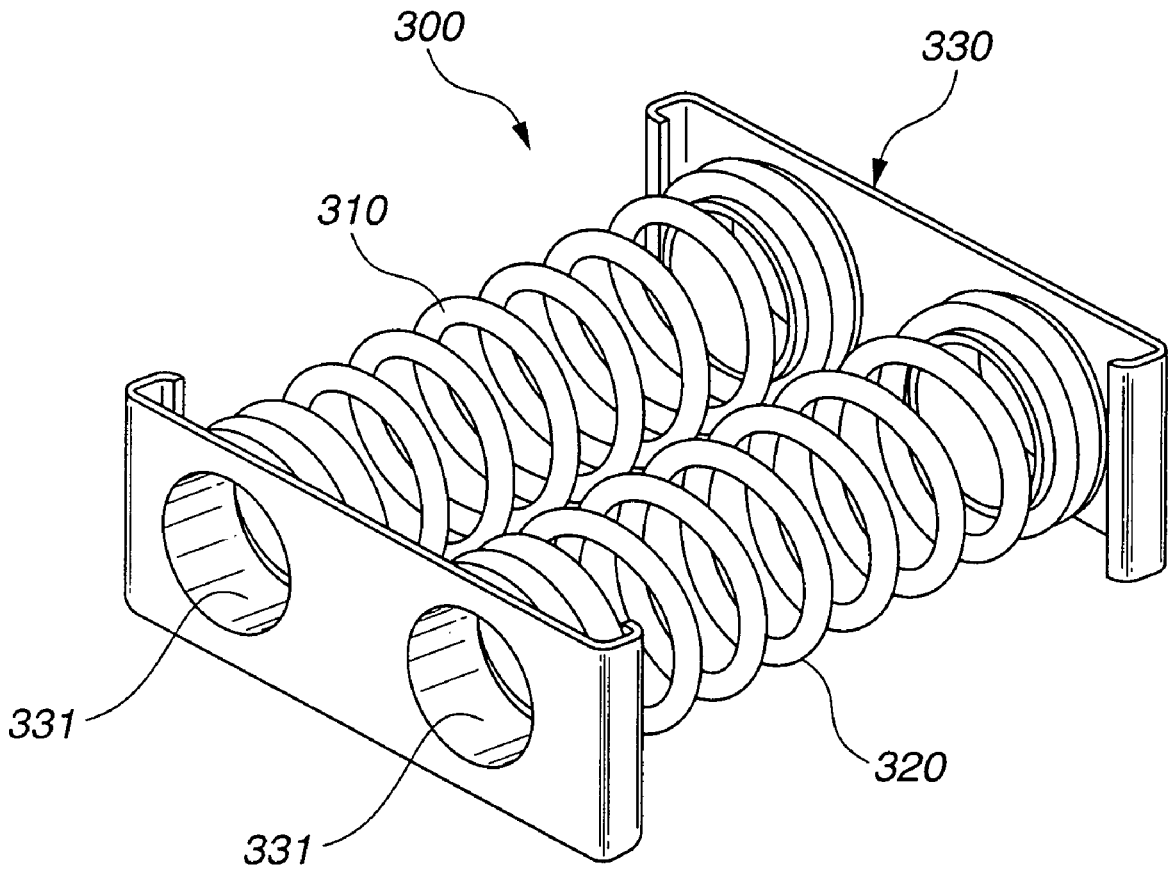
FIG. 3 is a perspective view of a spring unit of the valve timing control apparatus according to the first embodiment of the invention.

Each of the spring units 300 has first and second coil springs 310 and 320 arranged in a parallel array and at least one spring holder 330 for holding the coil springs 310 and 320 in such a manner that the coil springs 310 and 320 are radially retained at least one end of the array. In the first embodiment, each spring unit 300 has two spring holders 330 sandwiching therebetween the coil springs 310 and 320 so that the coil springs 310 and 320 are radially retained at opposite ends of the array as shown in FIG. 3.

The coil springs 310 and 320 are aligned along the direction of relative rotation between the housing 10 and the vane rotor 20 and symmetrically with respect to the x-axis direction. Further, the coil springs 310 and 320 have the same length and tension strength but are opposite in winding direction in the first embodiment. Although the spring unit 300 has two coil springs 310 and 320 in the first embodiment, the number of spring members in each spring unit 300 is not particularly restricted. The spring unit 300 may be alternatively provided with one or more additional coil springs.

The spring holders 330 are formed by subjecting rectangular metal sheets to press working such that opposite ends of the spring holders 330 are bent inwardly. Two cylindrical protrusions 331 are provided on each spring holder 330 to extend in the same direction perpendicular to the spring holder 330. The diameters of the protrusions 331 are adjusted such that the coil springs 310 and 320 are fitted around the respective protrusions 331. Upon fitting the opposite ends of the coil springs 310 and 320 around the protrusions 331, the coil springs 310 and 320 can be held perpendicularly to the spring holders 330 and prevented from being inclined and coming into contact with each other during compression of the coil springs 310 and 320 so as to obtain an improvement in durability.

Recesses 112, 212 and 222 are formed in side walls of the shoes 110 and the vanes 210 and 220 facing the hydraulic chambers 500, respectively, to extend along the x-axis direction. The spring holders 330 are engaged in the respective recesses 112, 212 and 222 upon insertion of the spring units 300 into the respective hydraulic chambers 500 from the rear side to the front side, thereby preventing radial sliding displacements of the spring holders 330 relative to the housing 10 and the vane rotor 20.

The rotation restriction mechanism has a protrusion 240 extending from the vane rotor 200 into any of the hydraulic chambers 500 in which the spring units 300 are arranged, as shown in FIGS. 4 and 5, to restrict the relative rotation of the housing 10 and the vane rotor 20 upon contact of the protrusion 240 with the shoe 110. In the first embodiment, the protrusion 240 is provided at a position adjacent to the second vane 220 (on the normal rotation side of the second vane 220) to extend radially outwardly from the outer circumferential surface of the rotor body 230 toward the spring unit 300. As the protrusion 240 can be formed integrally with the rotor body 230 at the time of die forming and sintering of the vane rotor 20 so as to have the same shape continuously from one rotor end to the other rotor end along the x-axis direction, the rotation restriction mechanism can be made simple in structure without the need to provide a special part or parts separately.

Figure 6:
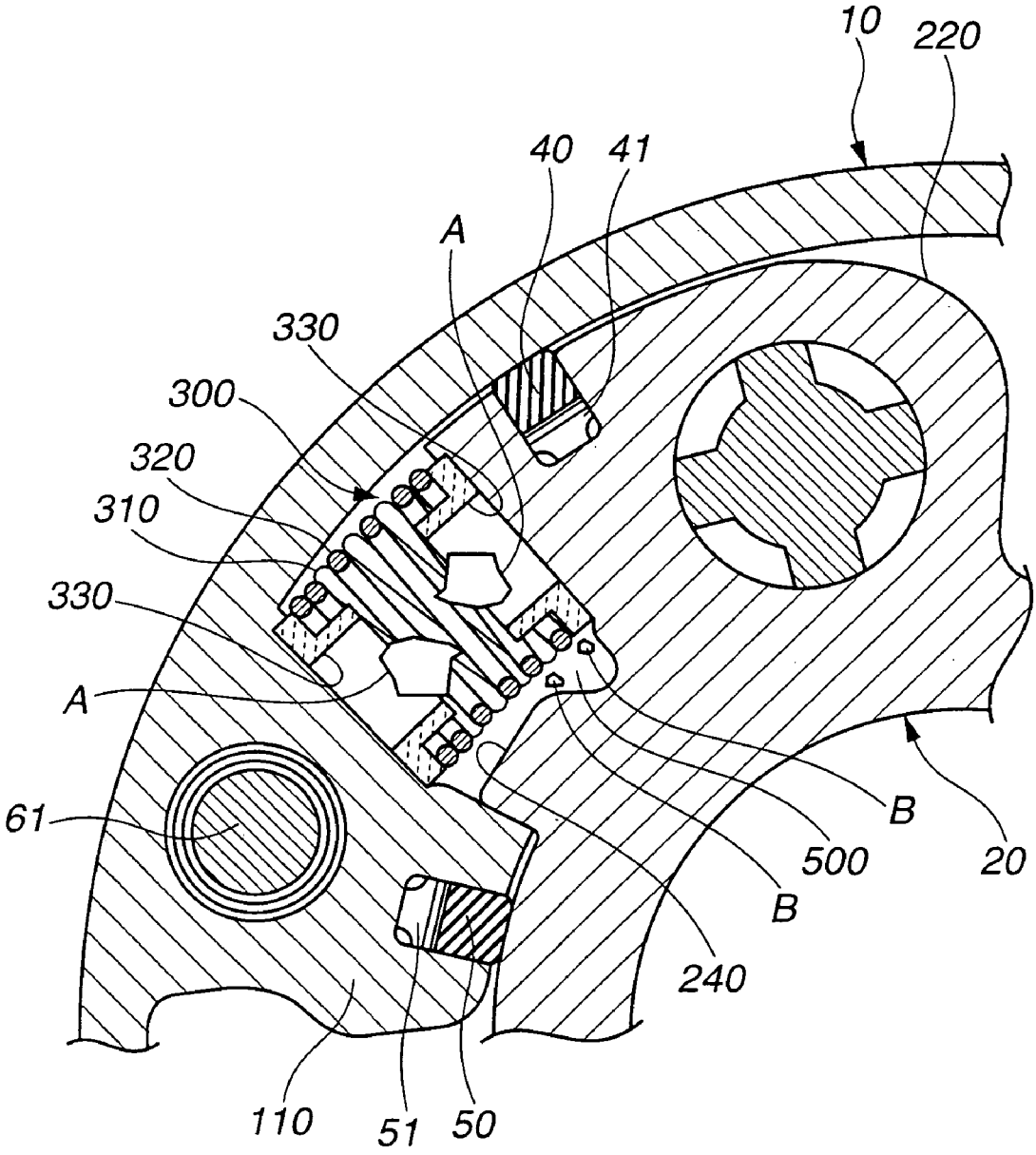
FIG. 6 is an enlarged sectional view of part of the valve timing control apparatus, when brought to an angular position at which the valve timing is most retarded, according to the first embodiment of the invention.

When the hydraulic pressures in the second hydraulic chambers 600 is greater than the sum of the hydraulic pressures in the first hydraulic chambers 500 and the tensions of the coil springs 310 and 320 of the spring units 300, the housing 10 and the vane rotor 20 are urged in the negative rotation direction and in the normal rotation direction, respectively, to minimize the internal volumes of the first hydraulic chambers 500 and maximize the internal volumes of the second hydraulic chambers 600 as shown in FIGS. 5 and 6. The rotational phase of the engine crankshaft relative to the camshaft 2 is then shifted to a most retarded phase position. In this state, the protrusion 240 abuts on the shoe 110 to keep the vanes 210 and 220 from contact with the shoes 110 at least within the hydraulic chambers 500 and prevent complete compression and plastic deformation of the coil springs 310 and 320 without allowing contact between wiring turns of the springs 310 and 320 and contact and interference between the protrusions 331 formed on the opposite faces of the spring holders 330 in the spring units 300. The spring mechanism can be thus prevented from changes in the tensions of the springs 310 and 320. Further, the coil springs 310 and 320 are kept from contact with the protrusion 240 during maximum compression as, shown in FIGS. 5 and 6, in the most retarded rotational phase of the engine crankshaft relative to the camshaft 2.

When no hydraulic pressures are applied to the first hydraulic chambers 500 and 600 or when the sum of the hydraulic pressures in first the hydraulic chambers 500 and the tensions of the coil springs 310 and 320 of the spring units 300 is greater than the hydraulic pressures in the second hydraulic chambers 600, the housing 10 and the vane rotor 20 are urged in the normal rotation direction and in the reverse rotation direction, respectively, to maximize the internal volumes of the first hydraulic chambers 500 and minimize the internal volumes of the second hydraulic chambers 600 as shown in FIG. 4. The rotational phase of the engine crankshaft relative to the camshaft 2 is then shifted to a most advanced phase position. The protrusion 240 is moved apart from the shoe 110, as shown in FIG. 4, with some space being left between the protrusion 240 and the coil springs 310 and 320.

In the case that the rotational phase of the engine crankshaft relative to the camshaft 2 is changed from the most advanced phase position to the most retarded phase position, the coil springs 310 and 320 may get deformed radially inwardly during compression. In such a case, however, the radially-outward protrusion 240 functions as a guide to prevent an excessive amount of radial inward deformation of the coil springs 310 and 320 and secure the tensions of the springs 310 and 320 properly.

The VTC apparatus 1 can be manufactured by: placing the vane rotor 2 in the housing 1; inserting the lock pin 21 into the through hole 223 of the second vane 220; fitting the spring 23 and the spring holder 22 onto the lock pin 21; engaging the spring units 300 into the respective hydraulic chambers 500; attaching the sprocket 30 to the front end of the housing 10 with the sleeve 11 and the sleeve holder 31 being coaxially aligned with the through hole 223; and then fastening the plate member 60 to the rear end of the housing 10 with the bolts 61.

The VTC apparatus 1 of the first embodiment has advantages over the earlier technology in its effect of preventing a deterioration in operation performance due to wear dust as follows.

It is now assumed that wear pieces A and B occur on the conditions that the wear pieces A are too large in size to pass through a hydraulic oil passage and that the wear pieces B are smaller in size than a diameter of the hydraulic oil passage.

In a vane-type valve timing control apparatus of the earlier technology, no rotation restriction mechanism (protrusion) is provided on a vane rotor so that coil springs get compressed until spring holders abut on each other. This results in insufficient space for suspending the wear particles A and B in the most retarded rotational phase between engine crankshaft and camshaft. If the wear pieces A enter into the coil springs, the wear pieces A are crushed/pulverized between protrusions of the spring holders and then get caught in any sliding parts to interfere with the operation of the valve timing control apparatus in the earlier technology. In order to avoid such interference, it is conceivable to form no protrusions on the spring holders. If the wear pieces A get caught between wiring turns of the coil springs, however, the coil springs cannot be compressed to a sufficient degree so that the valve timing control apparatus fails to achieve the most retarded rotational phase between the engine crankshaft and camshaft in the earlier technology. Further, the coil springs may be broken by the wear pieces A being pressed between wiring turns of the coil springs so that the broken pieces of the coil springs get caught in between the vane rotor and the housing to render the valve timing control apparatus inoperative in the earlier technology. Even if the coil springs are arranged alone with no spring holders, the wear pieces A may be crushed/pulverized between shoes of the housing and vanes of the rotor and between wiring turns of the coil springs and get caught in any sliding parts to interfere with the operation of the valve timing control apparatus in the earlier technology. The wear pieces B may also get caught in any sliding parts to interfere with the operation of the valve timing control apparatus in the earlier technology.

In the first embodiment, by contrast, the protrusion 240 abuts on the shoe 110 to prevent contact between the spring holders 330 and leave some space inside the coil springs 310 and 320 and between the wiring turns of the coil springs 310 and 320 when the coil springs 310 and 320 comes to a maximum compression state to achieve the most retarded rotational phase of the crankshaft relative to the camshaft 2. The wear pieces A and B are thus suspended in the space inside the coil springs 310 and 320 and between the wiring turns of the coil springs 310 and 320, as shown in FIG. 6, and prevented from becoming crushed/pulverized between the protrusions 331 of the spring holders 330 and between the shoes 110 and the vanes 210 and 220 and caught in any sliding parts of the VTC apparatus 1. In case of breakage of the coil springs 310 and 320, the broken pieces of the coil springs 310 and 320 are accommodated in the space left inside the coil springs 310 and 320 and between the wiring turns of the coil springs 310 and 320. It is therefore possible to secure the proper operation response of the VTC apparatus 1.

Although the spring units 300 are provided in the hydraulic chambers 500 in the first embodiment, the same effects can be obtained even by providing the spring units 300 in either respective ones of the second hydraulic chambers 600 or the first and second hydraulic chambers 500 and 600.

Figure 7:
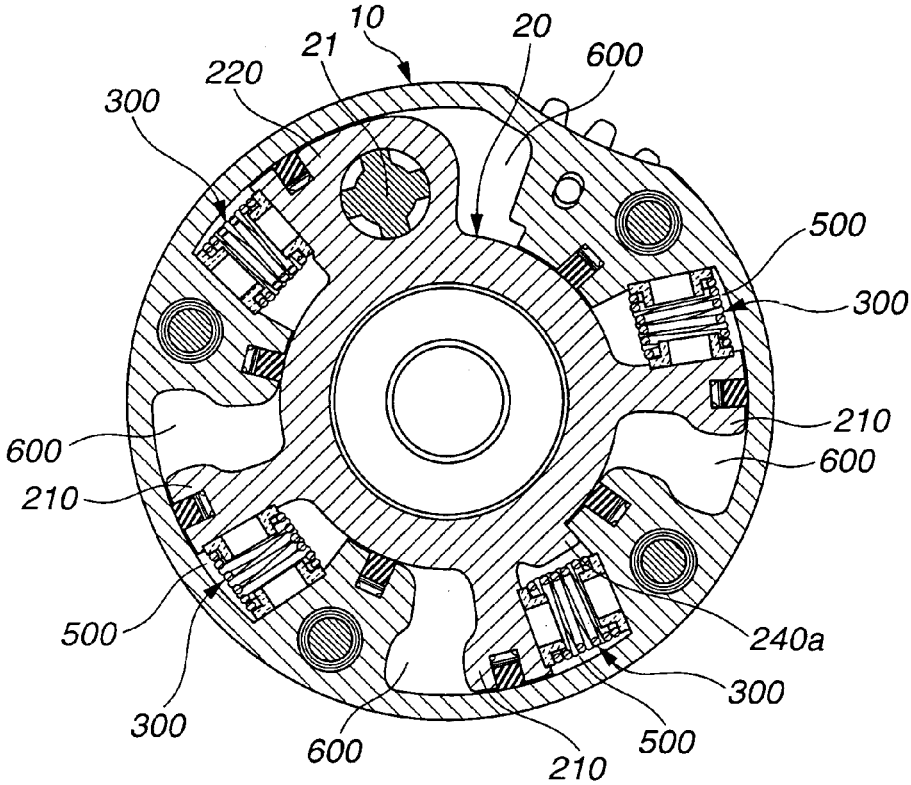
FIG. 7 is a sectional view of a valve timing control apparatus according to a second embodiment of the invention.

Next, the second embodiment of the present invention will be explained below with reference to FIG. 7. The second embodiment is structurally similar to the first embodiment, except for the location of the rotation restriction mechanism. The rotation restriction mechanism of the second embodiment has a protrusion 240*a* formed on the rotor body 230 within the hydraulic chamber 500 adjacent to one of the first vanes 210 diagonally opposite to the second vane 220 as shown in FIG. 7. With such an arrangement of the protrusion 240*a*, it is possible to further improve the weight balance of the vane rotor 20 and minimize the shaking of the vane rotor 20 upon actuation of the VTC apparatus 1 even though the second vane 220 is lager in size and weight than the first vanes 210.

Figure 8:
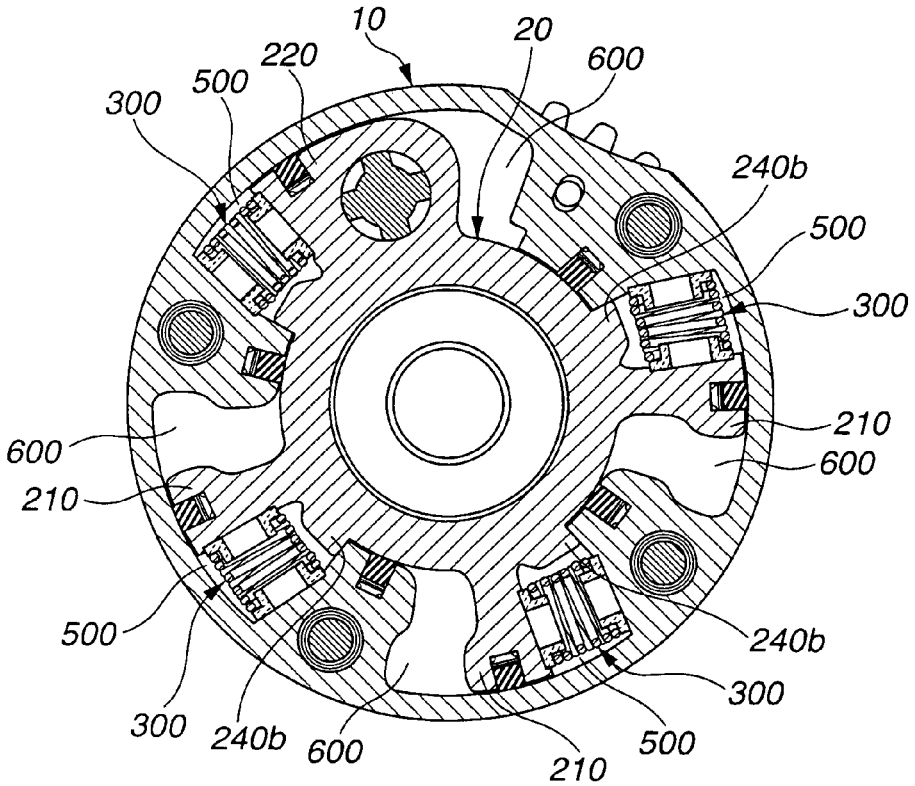
FIG. 8 is a sectional view of a valve timing control apparatus according to a third embodiment of the invention.

The third embodiment of the present invention will be next explained below with reference to FIG. 8. The third embodiment is structurally similar to the first embodiment, except for the structure of the rotation restriction mechanism. The rotation restriction mechanism of the third embodiment has protrusions 240*b* extending from the rotor body 230 into some or all of the hydraulic chambers 500, respectively. In the third embodiment, four protrusions 240*b* are provided in the respective hydraulic chambers 500 as shown in FIG. 8. It is thus possible to reduce the load on each protrusion 240*b* and improve the durability of the rotation restriction mechanism. In the case of providing the protrusions 240*b* in some of the hydraulic chambers 500, it is possible to achieve the weight reduction of the rotation restriction mechanism while improving the durability of the rotation restriction mechanism as compared to the case of providing the protrusions 240*b* in all of the hydraulic chambers 500.

Figure 9:
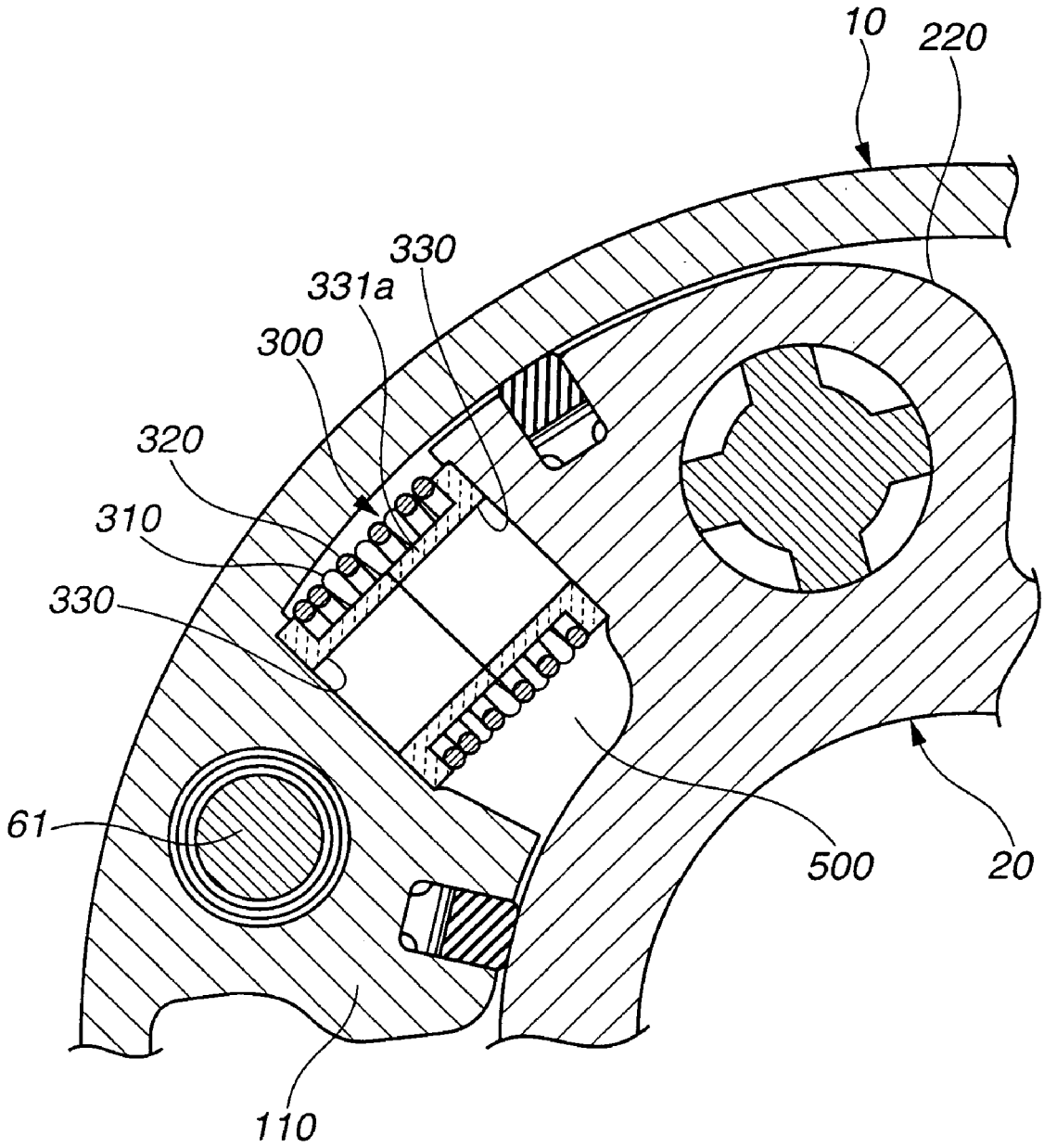
FIG. 9 is an enlarged sectional view of part of a valve timing control apparatus according to a fourth embodiment of the invention.

Finally, the fourth embodiment of the present invention will be next explained below with reference to FIG. 9. The fourth embodiment is structurally similar to the first to third embodiments, except for the structure of the rotation restriction mechanism. Although the protrusion or protrusions 240, 240*a*, 240*b* are used as the rotation restriction mechanism in the first, second or third embodiment, the structure of the rotation restriction mechanism is not limited to such a protrusion or protrusions 240, 240*a*, 240*b*. The rotation restriction mechanism may have any other structure. For example, the spring holders 330 have protrusions 331*a* made longer to restrict the relative rotation between the housing 10 and the vane rotor 20 and keep the shoes 110 and the vanes 210, 220 separated from each other, even during maximum compression of the springs 310 and 320, upon contact of the protrusions 331*a* in the fourth embodiment as shown in FIG. 9. The rotation restriction mechanism can be thus made simple in structure and low in cost without the need to process the vane rotor 20 etc. Alternatively, a circumferentially extending stopper or stoppers may be provided on any of the shoes 110 and the vanes 210 and 220 so as to function as the rotation restriction mechanism.

The entire contents of Japanese Patent Application No. 2004-270717 (filed on Sep. 17, 2004) are herein incorporated by reference.

Although the present invention has been described with reference to specific embodiments of the invention, the invention is not limited to the above-described embodiments. Various modification and variation of the embodiments described above will occur to those skilled in the art in light of the above teaching. Alternatively, the rotation restriction mechanism may be arranged in the second hydraulic chamber or chambers 600 not only in the first embodiment but also in the second to fourth embodiments. Although the VTC apparatus 1 is mounted on an intake or exhaust camshaft 2 to control intake or exhaust valve open/close timing of the engine in the first to fourth embodiments, VTC apparatuses 1 can alternatively be mounted on both of intake and exhaust camshafts 2 to control intake and exhaust valve open/close timing of the engine. Further, the housing 10 and the vane rotor 20 may be fixed to the camshaft and the sprocket 30, respectively. The valve train structure of the engine is not limited to the above. For example, the valve train structure may alternatively be designed such that the rotation of the engine crankshaft is directly transmitted to both of the intake and exhaust camshafts 2 via the chain, or transmitted to one of the intake and exhaust camshafts 2 via the chain and then to the other of the intake and exhaust camshafts 2 via another rotary member separately. The scope of the invention is defined with reference to the following claims.

What is claimed is:

1. A valve timing control apparatus for an internal combustion engine, comprising:

a rotary member rotated by a crankshaft of the engine;

a housing fixed to one of the rotary member and a camshaft of the engine, the housing having a housing body and shoes protruding from an inner circumferential surface of the housing body to define actuation spaces therebetween;

a vane rotor disposed in the housing and fixed to the other of the rotary member and the engine camshaft, the vane rotor having a rotor body and vanes protruding from an outer circumferential surface of the rotor body into the respective actuation spaces to divide the actuation spaces into circumferentially alternating first and second hydraulic chambers:

a fluid supply/drain block through which hydraulic fluid is supplied to and drained out of the first and second hydraulic chambers;

a plurality of spring units arranged in at least either the first hydraulic chambers or the second hydraulic chambers to bias the vane rotor in a rotational direction with respect to the housing; and a rotation restriction mechanism capable of restricting a relative rotation of the housing and the vane rotor to prevent contact of the mutually facing surfaces of the shoes and the vanes within the hydraulic chambers in which the spring units are arranged.

2. The valve timing control apparatus of claim 1, wherein the rotation restriction mechanism has a protrusion extending from the vane rotor into any of the hydraulic chambers in which the spring units are arranged.

3. The valve timing control apparatus of claim 2, wherein the protrusion extends radially outwardly from the rotor body toward the spring unit.

4. The valve timing control apparatus of claim 1, wherein the vane rotor has a lock mechanism disposed in either one of the vanes so as to lock the vane rotor in a given rotational position with respect to the housing appropriate for a start of the engine, and the rotation restriction mechanism has a protrusion adjacent to any of the vanes diagonally opposite to said either one of the vanes in which the lock mechanism is disposed.

5. The valve timing control apparatus of claim 4, wherein the lock mechanism includes: a hole formed in said either one of the vanes along an axial direction of the vane rotor; a lock pin slidably inserted in the hole; a spring member that urges the lock pin to project from said either one of the vanes; a sleeve that receives an end portion of the lock pin projected from said either one of the vanes; and means for disengaging the lock pin from the sleeve in accordance with a starting condition of the engine.

6. The valve timing control apparatus of claim 4, wherein the vane rotor has four vanes circumferentially evenly spaced around the rotor body.

7. The valve timing control apparatus of claim 4, wherein the spring units each have coil springs, and the rotation restriction mechanism restricts the relative rotation of the housing and the vane rotor to prevent the coil springs from complete compression.

8. The valve timing control apparatus of claim 4, wherein the rotation restriction mechanism has a plurality of protrusions extending from the vane rotor so as to be contactable with the housing.

9. The valve timing control apparatus of claim 1, wherein each of the spring units has spring members and spring holders holding therebetween the spring members, and the rotation restriction mechanism has protrusions extending from opposite faces of the spring holders so as to be contactable with each other under compression of the spring members.

10. The valve timing control apparatus of claim 1, wherein the spring units are arranged in either respective ones of the first or second hydraulic chambers or the first and second hydraulic chambers.

11. The valve timing control apparatus of claim 1, wherein each of the spring units has a plurality of spring members arranged in a parallel array.

12. The valve timing control apparatus of claim 11, wherein the spring units have spring holders for holding the spring members in such a manner that the spring members are radially retained at one end of said array in each of the spring units.

13. The valve timing control apparatus of claim 12, wherein either the shoes or the vanes have recesses axially formed in side walls thereof so that the spring holders are engaged in the recesses, respectively.

14. The valve timing control apparatus of claim 11, wherein the spring units have spring holders for holding the spring members in such a manner that the spring members are radially retained at opposite ends of said array in each of the spring units.

15. The valve timing control apparatus of claim 14, wherein the shoes and the vanes have recessed axially formed in side walls thereof so that the spring holders are engaged in the recesses, respectively.

16. The valve timing control apparatus of claim 2, wherein the protrusion is formed integrally with the vane rotor.

17. The valve timing control apparatus of claim 16, wherein the protrusion extends continuously from one rotor end to the other rotor end along an axis direction of the vane rotor.

18. The valve timing control apparatus of claim 1, wherein the spring units each have coil springs, and the rotation restriction mechanism restricts the relative rotation of the housing and the vane rotor to prevent the coil springs from plastic deformation.

19. A valve timing control apparatus for an internal combustion engine, comprising:

a rotary member rotated by a crankshaft of the engine;

a housing fixed to one of the rotary member and a camshaft of the engine, the housing having a housing body and shoes protruding from an inner circumferential surface of the housing body to define actuation spaces therebetween;

a vane rotor disposed in the housing and fixed to the other of the rotary member and the engine camshaft, the vane rotor having a rotor body and vanes protruding from an outer circumferential surface of the rotor body into the respective actuation spaces to divide the actuation spaces into circumferentially alternating first and second hydraulic chambers;

a fluid supply/drain block through which hydraulic fluid is supplied to and drained out of the first and second hydraulic chambers; and a plurality of springs arranged in at least either the first hydraulic chambers or the second hydraulic chambers to bias the vane rotor in a given rotational direction with respect to the housing, wherein, in case of breakage of the springs, said at least either the first hydraulic chambers or the second hydraulic chambers in which the springs are arranged allow space to accommodate therein broken pieces of the springs during maximum compression of the springs.

20. The valve timing control apparatus of claim 19, wherein said space to accommodate therein broken pieces of the springs is located radially inwardly of the springs.

* * * * *